United States Patent [19]

Holmér

[11] Patent Number: 4,938,181

[45] Date of Patent: Jul. 3, 1990

[54] VALVE FOR INTERNAL COMBUSTION ENGINES

[75] Inventor: Ernst Holmér, Goteborg, Sweden

[73] Assignee: AB Volvo, Goteborg, Sweden

[21] Appl. No.: 433,837

[22] Filed: Nov. 9, 1989

[30] Foreign Application Priority Data

Nov. 15, 1988 [SE] Sweden ..... 8804120

[51] Int. Cl.[5] ..... F01L 3/00

[52] U.S. Cl. ..... 123/188 AA; 123/188 GC; 123/188 A

[58] Field of Search ..... 123/188 AA, 188 GC, 123/188 A

[56] References Cited

U.S. PATENT DOCUMENTS 3,998,199 12/1976 Melchior ..... 123/188 GC
4,495,906 1/1985 Bender et al. ..... 123/188 GE

FOREIGN PATENT DOCUMENTS 118788 3/1901 Fed. Rep. of Germany .
301617 2/1921 Fed. Rep. of Germany .
504570 7/1920 France .
656439 5/1929 France .
104130 2/1917 United Kingdom .
106566 5/1917 United Kingdom .
128981 7/1919 United Kingdom .
556778 10/1943 United Kingdom ..... 123/188 GC

*Primary Examiner*—E. Rollins Cross
*Attorney, Agent, or Firm*—Young & Thompson

[57] ABSTRACT

The invention relates to a valve which is intended for internal combustion engines and which comprises a valve-head (2) which has formed thereon a circular abutment surface for sealing coaction with a valve seat (9). The valve-head (2) has connected therewith a valve-stem (3) by means of which the valve is moveably journalled in a valve-guide (10). According to the invention, the valve-head (2) has a relatively small wall-thickness, and the valve-stem (3) has provided thereon a collar (16) which on the side thereof distal from the valve-plate (2) has an abutment surface (17) for abutment with a fixed abutment surface.

5 Claims, 2 Drawing Sheets

VALVE FOR INTERNAL COMBUSTION ENGINES

The present invention relates to a valve which is intended for internal combustion engines and which includes a valve-head which has provided thereon a circular surface for sealing coaction with a valve seat, and which further comprises a valve-stem which is joined to the valve-head and by means of which the valve is moveably journalled in a valve guide.

Poppet valves are used in almost all internal combustion engines for controlling communication between the combustion-chamber and inlet and outlet ducts. The valves are opened and closed by means of valve mechanisms which normally include a cam shaft which is provided with cams for activation of the individual valves. Efforts are made with modern engines to achieve higher efficiencies, and consequently it is of interest to improve the exchange of gas between the cylinder combustion-chamber and the inlet and outlet ducts. It is therefore desirable that the valves will open and close as quickly as possible, so as to reduce the throttling effect which occurs when the valve is partially open.

In order to ensure that the valve can be opened rapidly, it is necessary to provide the cams with steep camming surfaces and to apply large forces. These forces result in high pressures on the cam-surfaces, which in turn may result in mechanical-strength problems. In order to ensure that the valve will close rapidly, it is necessary to use powerful valve-springs, such springs resulting in powerful forces and high stresses when the valve-head strikes the valve-seat which also results in mechanical-strength problems. These problems are made worse by the fact that in order to enable the valves to withstand the mechanical stresses and strains to which they are subjected, the valves have been made thicker, therewith resulting in a greater mass, which in turn results in higher inertia forces, particularly at high engine speeds. These problems are further accentuated with larger valve-diameters, particularly with a view to the fact that the valve must be capable of withstanding the large forces which occur as a result of combustion pressure in the combustion chamber.

The object of the present invention is to provide a valve with which the aforesaid drawbacks are avoided and which will be relatively light in weight, even when the valve-head has a large diameter. This object is achieved with a valve constructed in accordance with the invention and having the characteristic features set forth in the characterizing clause of claim 1.

Figure 1:
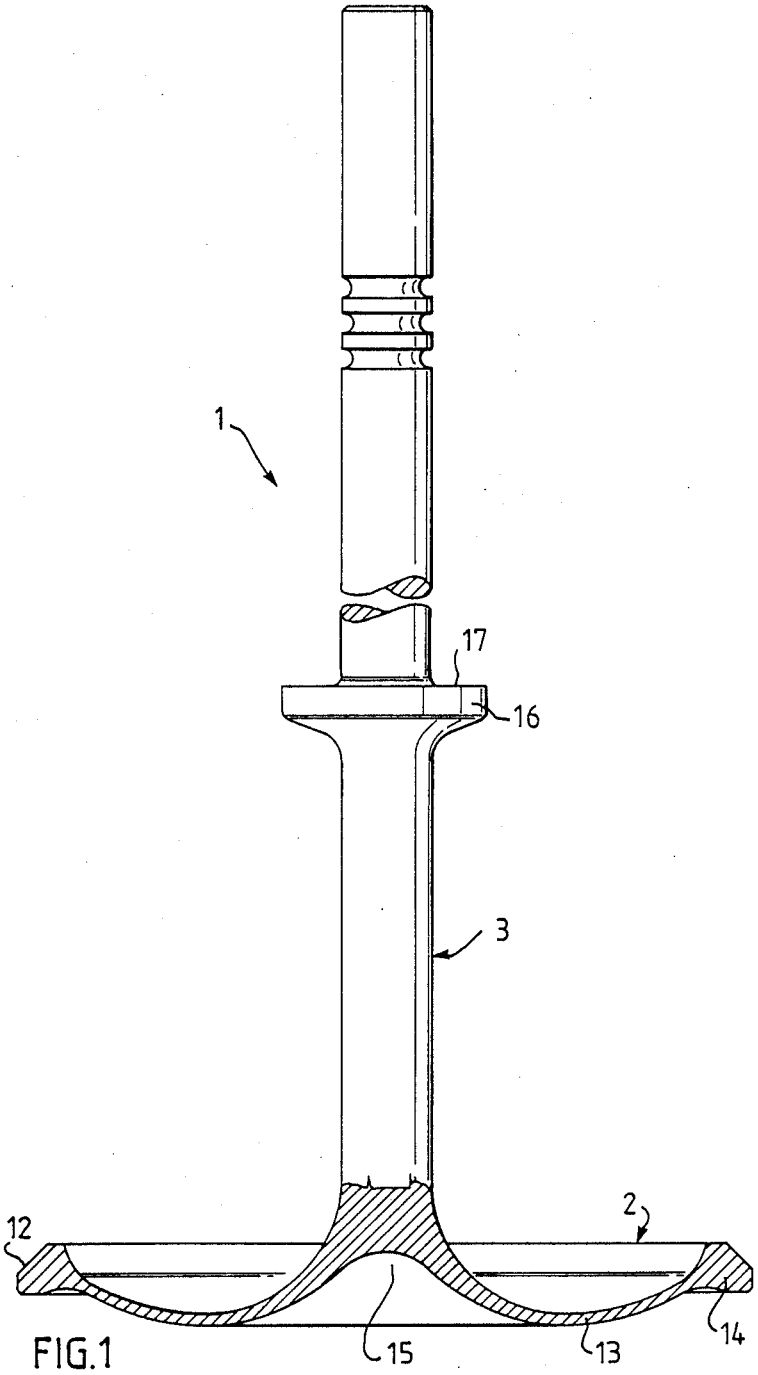
Figure 2:
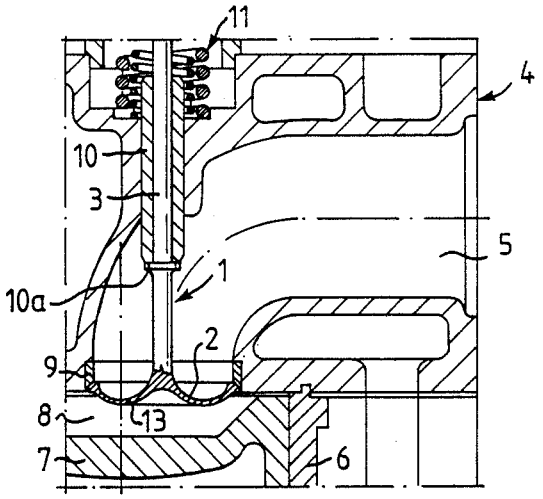
Figure 3:
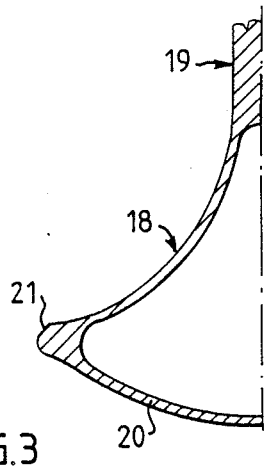

The invention will now be described in more detail with reference to the accompanying drawing, in which FIG. 1 is a partly cut-away side-view of a first embodiment of a valve constructed in accordance with the invention;

FIG. 2 is a sectional view of a part of an internal combustion engine provided with an inventive valve according to FIG. 1; and FIG. 3 is a sectional view of part of a valve constructed in accordance with a second embodiment of the invention.

The drawing illustrates a valve 1 which comprises a valve-head to which there is joined a valve-stem 3. FIG. 2 shows the valve 1 fitted to an internal combustion engine, of which there is shown solely part of a cylinder head 4, together with a duct 5, part of a cylinder 6 and a piston 7 mounted in the cylinder. The cylinder head 4, the cylinder 6 and the piston 7 together define a combustion chamber 8 into which the duct 5 opens. The valve 1 is intended to control the exchange of gas between the duct 5 and the combustion chamber 8. To this end, the valve-head 2 is intended to coact with a valve seat 9 located at the outlet orifice of the duct 5, and the valve-stem 3 is guided in a valve guide 10 rigidly mounted on the cylinder head 4. The valve 1 is operated by means of a valve mechanism of known kind, of which only a double valve-spring 11 is shown in the drawing.

As will be seen in particular from FIG. 1, the valve-head 2 has only a small thickness between the centre part of the valve-head, where the valve-stem joins the head, and the outer periphery of the head, said outer periphery being configured with an oblique circular abutment surface 12 intended for coaction with the valve seat 9. Because of the thinness of the valve-head, the weight of the valve as a whole will be small, and consequently the valve-opening and valve-closing forces which need be exerted by the valve mechanism will also be small. In order to enable the valve-head 2 to withstand the forces which act on the valve-head during operation, the valve-head 2 is provided, in accordance with the embodiment illustrated in FIG. 1, with a part 13 which is convex in a direction away from the valve-stem 3. The convex part 13 is configured as a circular part located between a thicker part 14 adjacent the abutment surface 12 and the central part of the valve-head 2 at which the valve-stem 3 joins said head. This central part therewith has the form of a recess 14.

The valve-stem 3 is provided between its two ends with a circular collar 16, which has a substantially flat abutment surface 17 on the side thereof remote from the valve-head 2. When the valve 2 occupies its closed position, the abutment surface 17 will lie against a rigid abutment surface, which may either be configured on the cylinder head or some part connected thereto. In the case of the FIG. 2 embodiment, this abutment surface consists in the end-surface 10*a* of the valve guide 10. When the abutment surface 17 abuts the end-surface 10*a* and the abutment 12 abuts the valve-seat 9, the forces acting on the valve-head 2 will be distributed between the abutment surfaces 12 and 17, thereby enabling the convex part 13 of the valve-head to be made very thin. In this respect, the convex part 13 is preferably curved in a manner such that the forces which act on the valve in operation will essentially generate compressive stresses solely in the material of the convex part 13. This will enable the material from which the valve-head 2 is made to be utilized to a maximum, particularly the material in the convex part 13. Consequently, the valve-head 2 will be much lighter in weight than the valve-head of a corresponding conventional valve.

In the case of the inventive valve, it is important that the valve-head 2 and the valve-stem 3 is so configured that the valve will function satisfactorily under all conditions, irrespective of prevailing valve temperatures and the temperatures of the parts coacting therewith. This implies that the distance between the abutment surfaces 12 and 17 must always correspond to the distance between the valve-seat 9 and the fixed abutment surface 10*a*, so that contact is achieved, both between the abutment surface 12 and the valve-seat 9, and between the abutment surface 17 and the fixed abutment-surface 10*a*, without appreciable deformation of any part of the valve.

The aforesaid temperature-independency of the inventive valve can be accomplished by appropriate curvature of the convex part 13 of the valve-head 2 and by suitable adaptation of the wall-thickness thereof. It is also conceivable in this regard to produce part of the valve-stem 3 from a material which has a coefficient of thermal expansion different to that of the remainder of said valve-stem.

FIG. 3 illustrates an alternative embodiment of a valve constructed in accordance with the invention. This Figure is a sectional view of solely one half of a valve-head 18 and a valve-stem 19 joined to the head. The valve of this embodiment is similar to the valve of the FIG. 1 embodiment, with the exception that the valve-head 18 of FIG. 3 consists of a hollow body. this hollow body has a part 20 which is convex in a direction from the valve-stem 19 and which extends over the whole of the valve surface expanding from the valve-stem 19 and which connects at its periphery with an abutment surface 21 intended for coaction with a valve-seat, e.g. the valve-seat 9 shown in FIG. 2. The convex part 20 of the valve embodiment shown in FIG. 3 is also curved in a manner such that the forces acting on the valve during operation will essentially generate compressive stresses solely in the convex part 20.

The invention is not restricted to the aforedescribed embodiments, since modifications can be made thereto within the scope of the following claims.

I claim:

1. A valve intended for internal combustion engines and including a valve-head (2) having a circular surface (12) for sealing coaction with a valve seat (9), and further comprising a valve-stem (3) which is joined to the valve-head (2) and which is moveably journalled in a valve-guide (10), characterized in that the valve-head (2) has a relatively small wall-thickness in cross-section; and in that the valve-stem (3) is provided with a collar (16) which presents on the side thereof remote from the valve-head (2) an abutment surface (17) intended for abutment with a fixed abutment surface (10*a*).

2. A valve according to claim 1, characterized in that the valve-head (2), on the side thereof remote from the valve-stem (3) is configured with a convex part (13, 20) of substantially constant wall-thickness.

3. A valve according to claim 2, characterized in that the convex part (13) of the valve-head (2) forms a ring which encircles a central recess (15) on the side remote from the valve-stem (3).

4. A valve according to claim 2, characterized in that the convex part (13, 20) of the valve-head (2) has a curvature such that the forces which act on the valve during operation will essentially generate compressive stresses in solely the convex part (13, 20).

5. A valve according to claim 1, characterized in that the abutment surface intended for abutment with the collar (16) on the valve-stem (3) comprises the end of the valve-guide (10).

* * * * *